United States Patent [19]

Thuries et al.

[11] 4,320,372

[45] Mar. 16, 1982

[54] CURRENT TRANSFORMER FOR A HIGH-TENSION INSTALLATION

[75] Inventors: Edmond Thuries, Meyzieu; Jean-Paul Sadoulet, Lyons; Alain Sanchez, Villeurbanne, all of France

[73] Assignee: Alsthom-Atlantique, Paris, France

[21] Appl. No.: 194,744

[22] Filed: Oct. 7, 1980

[30] Foreign Application Priority Data

Oct. 11, 1979 [FR] France ..... 79 25306

[51] Int. Cl.[3] ..... H01F 27/02; H01F 40/06

[52] U.S. Cl. ..... 336/92; 336/174; 336/195

[58] Field of Search ..... 336/174, 175, 173, 176, 336/62, 90, 92, 195, 94

[56] References Cited

U.S. PATENT DOCUMENTS

| | | | |
|---|---|---|---|
| 2,809,358 | 10/1957 | Whitney | 336/174 |
| 2,862,194 | 11/1958 | Coggeshall et al. | 336/174 X |
| 2,957,150 | 10/1960 | Jennings et al. | 336/174 |
| 2,957,151 | 10/1960 | Jennings et al. | 336/174 |
| 3,281,521 | 10/1966 | Wilson | 336/174 X |
| 3,456,222 | 7/1969 | Berg | 336/174 X |

FOREIGN PATENT DOCUMENTS

| | | | |
|---|---|---|---|
| 874133 | 7/1942 | France | 336/174 |
| 1100351 | 9/1955 | France | 336/174 |
| 1288166 | 2/1962 | France | 336/174 |
| 525546 | 8/1972 | Switzerland | 336/174 |

*Primary Examiner*—Thomas J. Kozma

*Attorney, Agent, or Firm*—Sughrue, Mion, Zinn, Macpeak & Seas

[57] ABSTRACT

The invention relates to a current transformer for a high-tension installation, said transformer including a primary winding, a secondary winding and a magnetic circuit, said primary winding including a primary turn suspended coaxial inner and outer conductors in an insulation chamber which contains a dielectric fluid. The secondary winding (28) and the magnetic circuit (27) are disposed around the primary turn (6) on the outside of the chamber. Electrical continuity of the insulation chamber past an insulating seal (24) therein is provided by a jumper (29) which passes round the outside of the secondary winding and the magnetic circuit. The invention applies in particular to very high tension installations.

8 Claims, 2 Drawing Figures

CURRENT TRANSFORMER FOR A HIGH-TENSION INSTALLATION

FIELD OF THE INVENTION

The invention relates to a current transformer for a high-tension installation.

BACKGROUND OF THE INVENTION

It is usual for the primary circuit to be isolated from ground both at the continuous operation voltage and at test voltages as required by regulations, while the secondary circuit is isolated from the primary circuit and generally has one of its terminals grounded. The magnetic circuit is either grounded or connected to the high-tension potential depending on whether the primary/secondary insulation is provided for the primary winding or for the secondary winding(s).

In the case of a grounded magnetic circuit, said circuit and the secondary circuit are sunk in a solid insulating material or are inserted in a casing which is itself grounded and filled with a liquid or gaseous insulating fluid. These casings are voluminous so as to contain the magnetic circuits and the outputs of the terminals of the secondary windings require sealed lead-through bushings which are difficult and expensive to produce. The magnetic circuits are inaccessible.

As for the solid insulation used between the live parts and ground, it is subjected to great dielectric stress and may be subject to ageing. In contrast, current transformers for high-tension installations generally have a high nominal current and hence the primary circuit comprises a single turn. In these conditions, even during a short circuit or a lightning strike, the voltage across the terminals of the primary circuit always remains very low.

It is therefore advantageous to avoid having organic insulating material between the primary conductor and ground, while the presence of organic insulating material between various components of the primary conductor does not constitute a real disadvantage. The invention aims to provide a current transformer in which the disposition of the component parts allows simplified insulation, improved accessibility and consequently advantageous implementation.

SUMMARY OF THE INVENTION

The invention provides a current transformer for a high-tension installation. The transformer comprises a primary winding, a secondary winding and a magnetic circuit. The primary winding comprises a primary turn suspended from coaxially disposed inner and outer conductors and housed in an insulation chamber in the form of an annular tank constituted by a plurality of generally tubular metal components connected end to end, with at least some of said components being curved. The chamber contains a dielectric fluid surrounding the primary turn. The magnetic circuit and the secondary winding are disposed around the primary winding outside the chamber and around one of said tubular metal chamber components designated as a carrier component. The carrier component is connected to one of the adjacent chamber components via an electrically insulating seal, with electrical continuity of the chamber being provided by an electrical connection which connects the adjacent end of said adjacent component to that end of the carrier component which is distant therefrom via a path which passes around the outside of both the magnetic circuit and the secondary winding.

According to another feature, the dielectric fluid contained in the insulating chamber is constituted by a gas.

The outer coaxial conductor may be constituted by a tube which is mechanically very rigid and may include at least one steel portion.

In accordance with one embodiment, the insulating chamber includes a stack of tubular insulators, whose diameters decrease with increasing height in the stack, the coaxial conductors being suspended from the upper end of the top insulator.

The ends of the primary turn may be fitted with conical sleeves whose ends are fitted with cylindrical connections, one of these connections being connected to a cylindrical connection disposed at the end of a conical sleeve of the outer coaxial tube and the other connection being connected to the central coaxial conductor via the cylindrical connection of the outer coaxial tube. The primary may be toroidal. An inspection cover is advantageously disposed on the metal tank which contains the primary turn opposite from its connection with the coaxial conductors.

An embodiment of the invention is described by way of example with reference to the accompanying drawings.

DESCRIPTION OF THE PREFERRED EMBODIMENT

Figure 1:
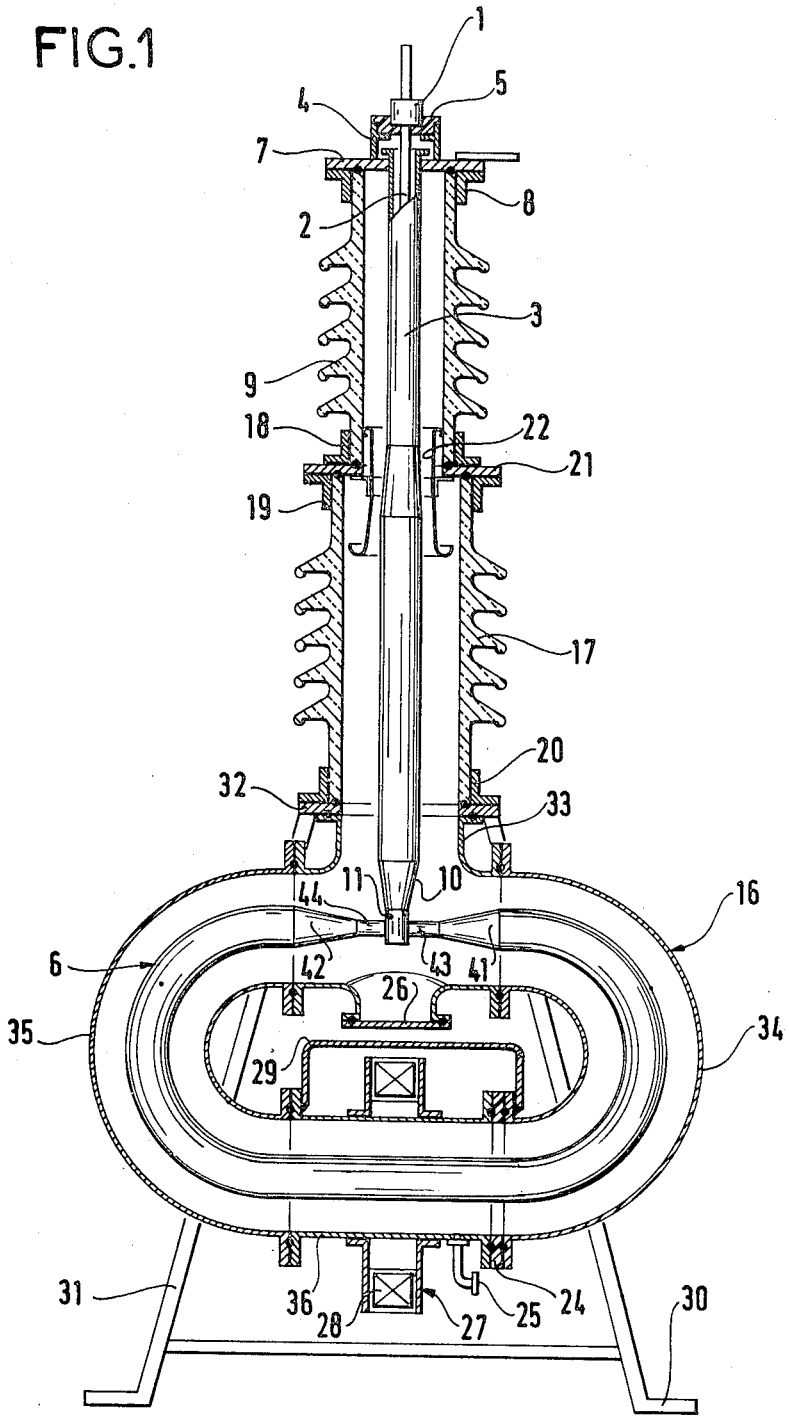
FIG. 1 is a schematic vertical axial cross-section of a transformer in accordance wtih the invention.
Figure 2:
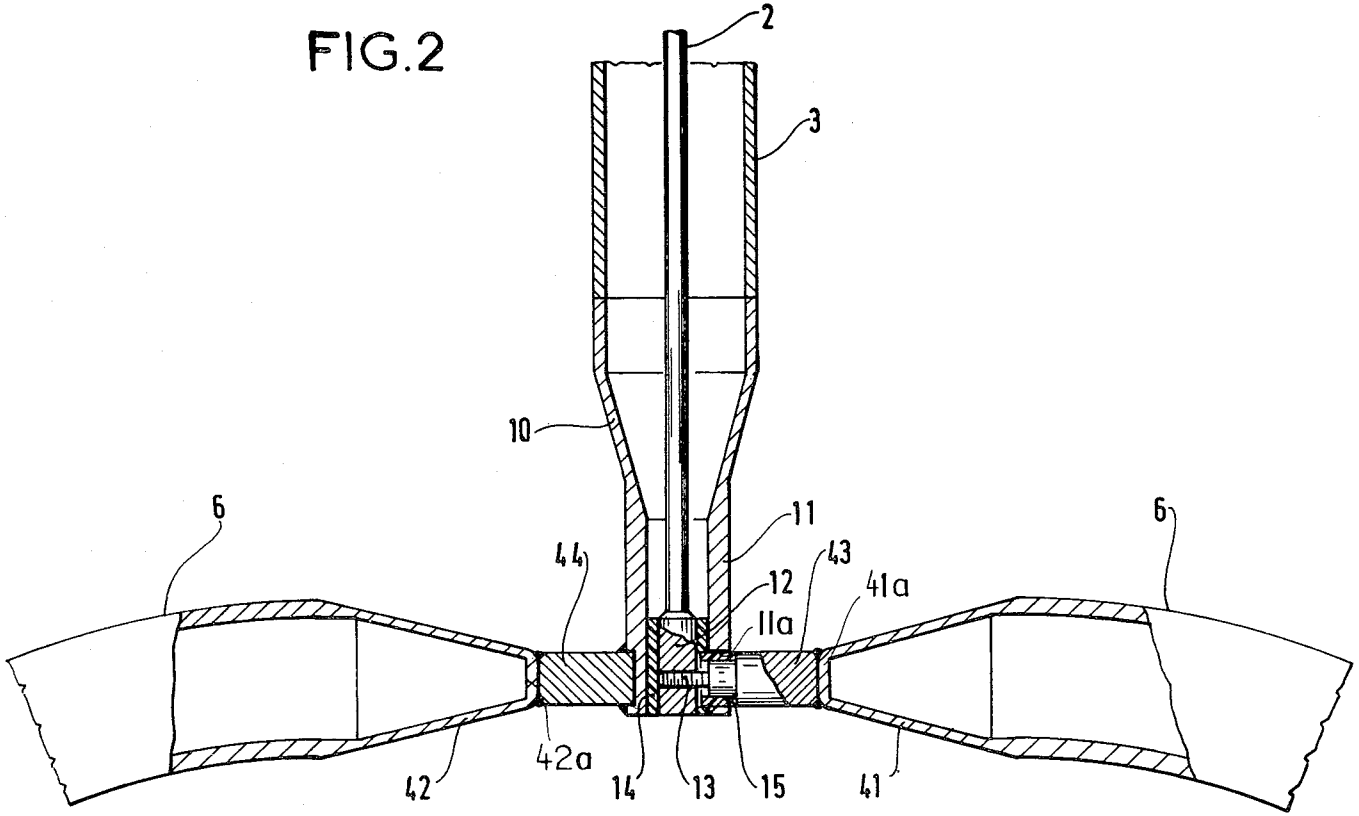
FIG. 2 is a detailed, enlarged and broken elevational view of the connection between the coaxial conductors and the primary turn.

In the figures, the input terminal 1 of a current transformer primary circuit is connected by a central vertical conductor 2 to the end of an annular primary turn 6. The other end of the primary turn 6 is connected via an outer coaxial conductor tube 3 to output terminal 4 of the primary circuit. The terminal 1 and the central conductor 2 are insulated from the terminal 4 and from the coaxial tube 3 by an insulating ring 5.

The primary circuit is disposed inside a sealed chamber filled with dielectric gas such as sulphur hexafluoride.

The sealed chamber includes a vertical upper portion constituted by a stack of tubular insulators such as 9 and 17 of stepped diameters for making modular assemblies that can be combined according to the voltage to be isolated.

Collars 8, 18, 19 and 20 are sealed to the ends of the insulators. Collars of different diameters, e.g. 18 and 19, are fixed on an intermediate plate 21. Guard rings such as 22 are connected to the plate 21 and are disposed in opposite directions to spread out the electric field.

Coaxial conductors 2 and 3 are suspended vertically about the axis of the insulators 9 and 17 via an end plate 7 fixed on the upper collar of the insulator 9.

The lower portion of the sealed chamber is constituted by an annular metal tank 16 with the primary turn 6 along its circular axis. The metal tank is formed by a plurality of sections 33,34,35 and 36. The upper section 33 includes an upper opening connected via a plate 32 to the lower collar 20 of the lower insulator 17, and a lower opening closed by an inspection cover 26.

The ends of the upper section 33 are connected to lateral sections 34 and 35 which are themselves connected to a horizontal lower section 36. However, an insulating ring 24 is interposed between the metal sections 34 and 36. The various components of the chamber are sealed to one another by conventional seals and the lower section 36 is provided with a filling point 25 for filling with dielectric gas and has pressure control means.

The primary turn 6 is tubular and its ends are fitted with frusto-conical sleeves 41 and 42 whose truncated ends 41*a*, 42*a* are extended by cylindrical connection parts 43 and 44. The lower end of the coaxial tube 3 is fitted with a frusto-conical sleeve 10 whose truncated end is extended by a integral cylindrical connection ring 11 connected at its periphery to the connection part 44. The lower end of the central conductor 2 has a cylindrical enlargement 12 inside the ring 11 and which is insulated therefrom by an insulating tube 14.

The ring 11 and the insulating tube 14 have a side opening 11*a* lined with an insulating tube 15, pointing away from the connection part 44, and through which a reduced diameter portion of the connection part 43 passes to make contact with the cylindrical enlargement 12 via a screw connection fitting 13.

The outer coaxial tube 3 may be very rigid and be constituted e.g. by a fairly thick aluminium alloy tube or even by a steel tube since the coaxial disposition of the conductors practically cancels the resulting magnetic field. The secondary circuit of the current transformer is disposed in outside air around the lower metal section 36. Thus it includes a magnetic circuit 27 around which a secondary winding 28 is wound. Equipotential conducting connections such as 29 are disposed around the secondary circuit to connect the end of the lateral section 34 facing an insulating seal 24 to the opposite end of the lower section 36 distant from the seal 24.

Since the voltage between the terminals 1 and 2 of the primary winding is always very low relative to the voltage between the primary conductor and earth, the insulation 5 and the tubes 14 and 15 only require low dielectric strength and these parts may be made from organic insulating materials.

The current transformer can be fixed in the unit by means of a frame 31 provided with legs 30 fixed on a plate 32 on which the lower collar 20 of the insulation casing is assembled. The tank 16 is suspended from the frame 31 to prevent the tank from being deformed and said frame supports the insulating casing from whose upper portion the primary winding as a whole is suspended.

Such a current transformer can be used as an insulating support for an isolating switch component.

Suitably shaped dismantleable tooling can be inserted through the cover 26 during assembly. Using the bearing surface of the cover 26 as a geometrical reference, said tooling allows the primary circuit height and angle about the vertical plane of symmetry to be adjusted to centre the live parts as accurately as possible in the earthed tank. After the primary circuit has been positioned and fixed, the tooling is removed and the cover 26 is closed.

Since insulation between the primary winding 3,6 and the earthed tank 16 is provided only by the insulating gas, the only leakage path between live parts and earth is along the ceramic insulators 9 and 17 and is very long.

No organic insulating material is subjected to the high voltage applied between the primary turn and earth. The tank 16 is provided with a valve and/or a membrane which limits possible overpressures due to an internal arc, for example. This avoids the danger of an explosion.

The current transformer described above has numerous advantages.

Using a primary turn connected to a pair of coaxial conductors suspended in a chamber filled with gas and in contact with solid parts only at the point of suspension makes it possible for the high voltage between a primary winding and earth to be applied only across the gas and via a very long leakage path along a ceramic insulator.

No organic insulating material is subjected to the stress of the very high voltage.

Using secondary windings disposed outside the chamber which contains the insulating gas makes it possible to:

Reduce the volume of gas to a minimum since at all points, the thickness of the gas corresponds to the dielectric strength between surfaces with large radii of curvature. Likewise, joining the coaxial conductor to the primary turn prevents any discontinuity causing a local increase in the electric field.

Assemble the secondary windings and make any necessary changes thereto much more easily.

Provide electrical continuity of the tank by means of an electrical connection outside the magnetic circuit and the secondary circuit without altering the properties of the magnetic circuit.

The coaxial conductors and the primary turn can be centered easily by using an inspection cover.

The use of cylindrical insulators of stepped diameters and which constitute modular assemblies that can be combined according to the voltage to be isolated reduces the manufacturer's production cost when an apparatus for several different nominal voltages is being manufactured.

Adding an isolating switch to the current transformer makes it possible to use the same support insulators in common therewith.

Installing such a current transformer instead of an insulation support on an isolating switch gives a saving of one insulation support.

The annular turn 6 may be in the shape of a torus which makes it practically insensitive to electrodynamic forces (in the case of a circular turn) thus preventing stresses and deformation in the turn while a short circuit current is passing through it.

We claim:

1. A current transformer for a high-tension installation, said transformer comprising:

an insulation chamber, coaxially disposed inner and outer conductors housed in said insulation chamber, a primary winding, a secondary winding, a magentic circuit, said primary winding comprising a primary turn suspended from said coaxially disposed inner and outer conductors, said insulation chamber including an annular tank housing said primary turn and being constituted by a plurality of generally tubular metal components connected end to end, with at least some of said components being curved, said insulation chamber containing a dielectric fluid surrounding the primary turn, said magnetic circuit and said secondary winding being disposed around the primary winding outside of said annular tank and around one of said tubular metal chamber components, said one tubular metal chamber component constituting a carrier component, said carrier component being connected to one of the adjacent chamber components via an electrically insulating seal, an electrical connection connecting the adjacent end of said adjacent component to that end of the carrier component to provide electrical continuity of said chamber which is spaced therefrom via a path which passes around the outside of both said magnetic circuit and said secondary winding.

2. A transformer according to claim 1, wherein the dielectric fluid contained in the insulation chamber is constituted by a gas.

3. A transformer according to claim 1, wherein said insulation chamber includes a stack of tubular insulators, said insulators being of decreasing diameter with increasing height in the stack, and wherein said coaxial conductors are suspended from the upper end of stack of tubular insulators.

4. A transformer according to claim 1, wherein said outer coaxial conductor is constituted by a tube which is mechanically very rigid.

5. A transformer according to claim 4, wherein said outer coaxial conductor tube includes at least one steel portion.

6. A transformer according to claim 1, wherein the ends of the primary turn are fitted with conical sleeves whose ends are fitted with cylindrical connections, one of these connections being connected to a cylindrical connection disposed at the end of a conical sleeve on the outer coaxial conductor and the other connection being connected to the inner coaxial conductor via the cylindrical connection of the outer coaxial tube.

7. A transformer according to claim 1, wherein an inspection door is disposed in the metal primary turn containing annular tank, and wherein said door is diametrically opposite the point where the coaxial conductors enter said tank.

8. A transformer according to claim 1, wherein the primary turn is toroidal.

* * * * *